US010294712B2

(12) United States Patent
Frantz et al.

(10) Patent No.: US 10,294,712 B2
(45) Date of Patent: May 21, 2019

(54) APPLIANCE DOOR ASSEMBLY

(71) Applicant: WHIRLPOOL CORPORATION, Benton Harbor, MI (US)

(72) Inventors: William Frantz, Berrien Springs, MI (US); Timothy E. Heater, Hartford, MI (US); Ndjeka K. Luhahi, Grand Rapids, MI (US); Nicholas E. Mawhorr, Granger, IN (US); Jose Aldo Ramirez, Monterrey (MX); Scott T. Thalls, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 316 days.

(21) Appl. No.: 15/350,683

(22) Filed: Nov. 14, 2016

(65) Prior Publication Data

US 2018/0135219 A1 May 17, 2018

(51) Int. Cl.

| | |
|---|---|
| ***E05D 3/08*** | (2006.01) |
| ***E06B 5/00*** | (2006.01) |
| ***D06F 39/14*** | (2006.01) |
| ***D06F 58/20*** | (2006.01) |
| ***E05D 11/00*** | (2006.01) |

(52) U.S. Cl.

CPC ..... *E06B 5/00* (2013.01); *D06F 39/14* (2013.01); *E05D 3/08* (2013.01); *E05D 11/0081* (2013.01); *D06F 58/20* (2013.01); *E05Y 2900/30* (2013.01); *E05Y 2900/312* (2013.01)

(58) Field of Classification Search

CPC ..... D06F 37/10; D06F 37/18; D06F 37/28; D06F 39/14; E05D 11/0081; E05Y 2900/312

See application file for complete search history.

(56) References Cited

U.S. PATENT DOCUMENTS

| | | | | |
|---|---|---|---|---|
| 3,883,201 | A * | 5/1975 | Busoni | D06F 37/28 49/167 |
| 7,137,173 | B2 | 11/2006 | Sipple | |
| 2007/0130730 | A1* | 6/2007 | Cho | D06F 39/14 16/387 |
| 2015/0123523 | A1* | 5/2015 | Woo | D06F 39/14 312/228 |

(Continued)

FOREIGN PATENT DOCUMENTS

| | | | |
|---|---|---|---|
| CN | 105420996 | A | 3/2016 |
| CN | 105442278 | A | 3/2016 |

(Continued)

OTHER PUBLICATIONS

European Search Report for Counterpart EP17197661.6, dated Feb. 28, 2018.

*Primary Examiner* — Daniel J Rohrhoff

(74) *Attorney, Agent, or Firm* — McGarry Bair PC

(57) ABSTRACT

A laundry appliance door assembly with a wire cover to protect the wire conductor that passes through the door hinge where it has a tendency to get pulled and damaged when the door is in motion. The wire cover includes a wire cover and a wire conduit coaxially connected together allowing the wire cover to rotate relative to the wiring conduit while within alignment of the hinge rotational axis. The wire cover comprises two lateral halves for ease of installation where it is designed to encase the wire conductor that passes through the door hinge.

20 Claims, 8 Drawing Sheets

(56) References Cited

U.S. PATENT DOCUMENTS

| | | | | |
|---|---|---|---|---|
| 2016/0194802 | A1* | 7/2016 | Heo | D06F 37/28<br>174/541 |
| 2018/0038040 | A1* | 2/2018 | Kim | D06F 39/14 |
| 2018/0216381 | A1* | 8/2018 | Lee | D06F 39/14 |

FOREIGN PATENT DOCUMENTS

| | | | |
|---|---|---|---|
| CN | 205223658 | U | 5/2016 |
| CN | 205368780 | U | 7/2016 |
| CN | 106032637 | A | 10/2016 |
| EP | 1654411 | B1 | 5/2006 |

* cited by examiner

APPLIANCE DOOR ASSEMBLY

BACKGROUND

A household appliance commonly has a cabinet defining an interior that is accessible through a door. Electronic devices, such as a user interface, can be partially or fully integrated into the door and supplied power or data from the cabinet. A wire harness typically passes from the cabinet to the door at a convenient location such as through the hinge knuckle or pin of a hinge connecting the door to the cabinet. The wire harness is subject to fatigue as the door is opened/closed, which can pull, move, twist, etc. the wire harness during each opening/closing.

BRIEF SUMMARY

One aspect of the invention relates to an appliance door assembly comprising a first door frame element having a first electrical conductor terminating in a first connector, a second door frame element having a second electrical conductor terminating in a second connector. A hinge having a first hinge plate mounted to the first door frame and having a first knuckle, a second hinge plate mounted to the second door frame and having a second knuckle, with a hinge pin rotationally coupling the first and second knuckles to define a hinge rotational axis. A wire cover having a first portion mounted to at least one of the second door frame, second hinge plate, or second knuckle for rotation about the hinge rotational axis and holding the second connector, wherein the first portion can be rotated to a first position away from at least one of the first and second hinge plates to expose the second connector for connection with the first connector, and rotated into a second position relative to one of the first or second hinge plates to hide the connected first and second connectors.

Another aspect of the invention relates to a method of assembling an appliance door having first and second door frames hingedly mounted for rotation about a rotational axis, the method comprising: rotationally mounting a wire cover to the door for rotation about the rotational axis, securing a first electrical connector to the wire cover, securing a second electrical connector to the first electrical connector, rotating the wire cover to predetermined position relative to the door to hide the connected first and second connectors, and securing the wire cover in the predetermined position.

DETAILED DESCRIPTION

Systems, components, and methodologies in accordance with the present disclosure enable a manufacturer of a laundry treating appliance to assemble the laundry treating appliance with greater ease and efficiency. Modern laundry treating appliances sometimes have electronic systems built into their doors, such as user interface systems. In certain implementations, the door is electrically connected to the cabinet of the laundry treating appliance. This may require a manufacturer to mount the door to the cabinet while also forming an electrical connection between the door and the cabinet. In some exemplary assembly procedures, one assembler holds the door in a mounting position while another assembler forms the electrical connection—this procedure is inefficient because it requires two individuals. In other cases, one individual both holds the door in a mounting position and makes the connection. This is cumbersome.

Systems, components, and methodologies in accordance with the present disclosure provide a wire cover that provides a convenient way to form electrical connections after the door is securely mounted to the cabinet. This is a great benefit to the assembler of the appliance as the weight associated with all portions of the door is carried by the cabinet and the assembler need not hold any portion of the door when making the connection.

Figure 1:
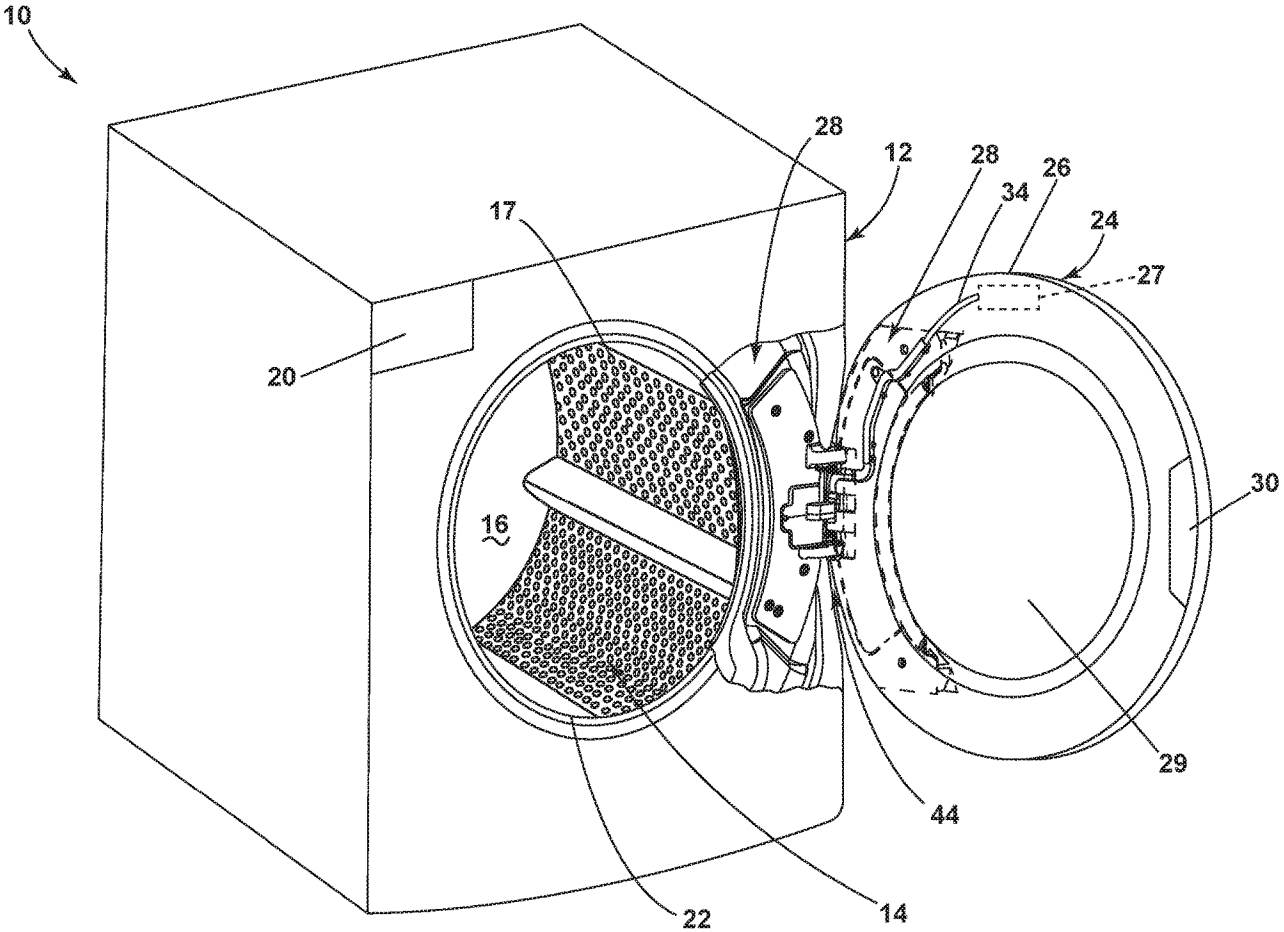
FIG. 1 is a perspective view of a horizontal axis laundry treating appliance incorporating aspects of the invention, with a door assembly of the laundry treating appliance showing a door in an opened position, and a wire harness having conductors passing between the cabinet and the door, with a protective wire cover.

FIG. 1 shows a perspective view of an exemplary laundry treating appliance in accordance with the present disclosure in the environment of a horizontal axis automatic clothes washing machine 10. Although much of the remainder of this application will focus on the embodiment of an automatic clothes washing machine, the present disclosure may have utility in other environments, including other laundry treating appliances, such as dryers or refreshers. The embodiments also have applicability in any configuration such as for both horizontal and vertical axis laundry treating appliances, regardless of whether they are top or front loading. Depending on the configuration, it is possible for the embodiments to have applicability in vertical axis washing machines and other appliances, refrigerators, microwaves, dishwashers, etc., having a hinged door designed to incorporate a wiring harness for electrical wirings to pass through. Embodiments can also have applicability outside of the home appliance market. Embodiments can have applicability in any implementation where wires are passed into a door.

The washing machine 10 shares many features of a conventional automated clothes washer and dryer, which will not be described in detail herein except as necessary for a complete understanding of the illustrative embodiments in accordance with the present disclosure. The laundry treating appliance of FIG. 1 is illustrated as a horizontal axis washing machine 10, which may include a structural support system comprising a cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system includes a tub (not shown) located within the interior of the cabinet 12 and defines a liquid-holding chamber in which liquid for the treating cycle is held during operation, and a drum 14 located within the tub and which can be rotatably mounted to the tub or the cabinet 12. A suspension system (not shown) suspends at least one of the tub and drum 14 relative to the cabinet 12.

The drum 14 defines a treating chamber 16 for receiving the laundry and rotates about a generally horizontal axis. The drum 14 can include a plurality of perforations 17 such that liquid can flow between the tub and the drum 14 through the perforations. The drum 14 is configured to receive a laundry load comprising articles for treatment, including, but not limited to, a hat, a scarf, a glove, a sweater, a blouse, a shirt, a pair of shorts, a dress, a sock, and a pair of pants, a shoe, an undergarment, and a jacket.

The washing machine 10 can also be provided with a dispenser 20 for dispensing treating chemistry to the treating chamber 16 for use in treating the laundry according to a cycle of operation. Non-limiting examples of treating chemistries that can be dispensed by the dispenser 20 during a cycle of operation include one or more of the following: water, detergents, softeners, bleach, rinse aids, surfactants, enzymes, fragrances, stiffness/sizing agents, wrinkle releasers/reducers, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The laundry holding system may further include a door assembly 24 including a door 26 that selectively opens/closes the opening 22 to the treating chamber 16. The door assembly 24 comprises first and second door frame elements 28 connected by a hinge 44. One of the door frame elements 28 mounts to the cabinet 12 and the other mounts to the door 26, with the hinge 44 connecting the door frame elements 28. The door frame element 28 associated with the door 26 defines a transparent window 29 to allow the user to see the inside of the treating chamber 16 through the door 26. The door 26 has a handle 30 for grasping the door 26 by a user and pivotally opening/closing the door about a hinge 44. The door 26 can be equipped with integrated electronic device 27 which requires electrical connection to pass through the hinge 44. The electronic device includes but is not limited to a user interface controller, a touch screen, a liquid crystal display, a proximity sensor or a Wi-Fi receiver.

Figure 2:
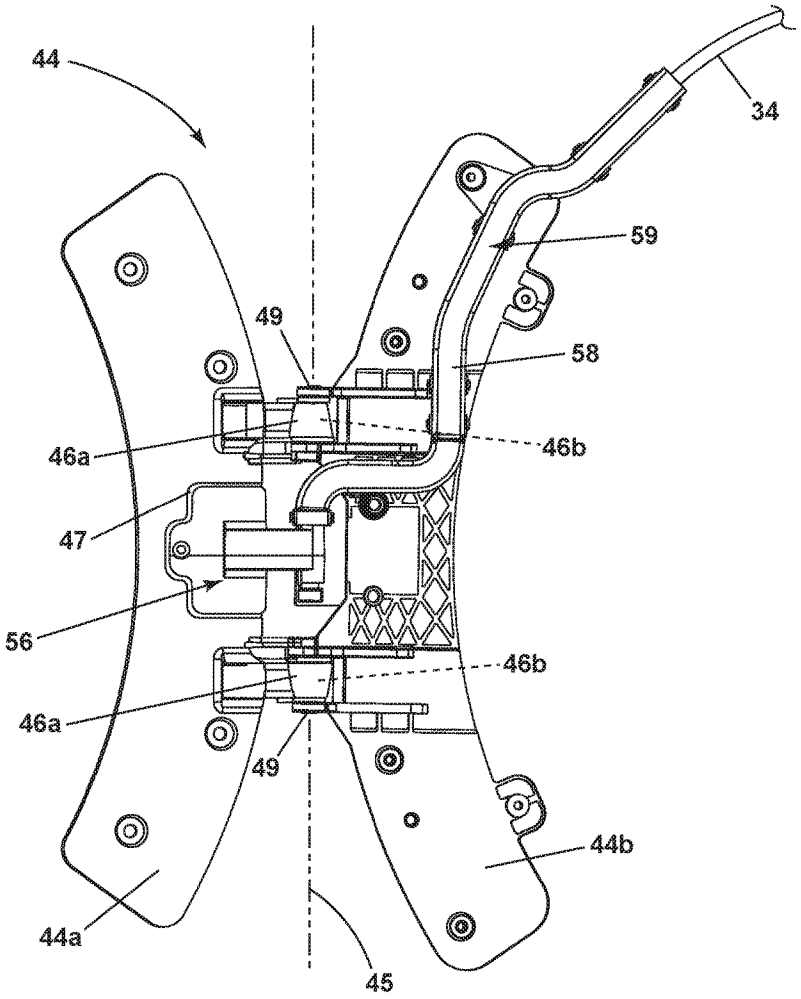
FIG. 2 is a front view of the door assembly of FIG. 1, with the door removed for clarity to show the hinge, wire harness, wire cover, and wire conduit with the hinge in the opened positioned.

Referring to FIG. 2, the hinge 44 comprises two hinge plates 44*a*, 44*b* pivotable relative to each other about a hinge rotational axis 45. The first hinge plate 44*a* has a first set of hinge knuckles 46*a* and mounted to the cabinet 12 via one of the door frame elements 28. The first hinge plate 44*a* includes a slot 47 to allow a conductor, such as a wire harness for the cabinet, to pass through from the cabinet 12. The second hinge plate 44*b* has a second set of knuckles 46*b* is mounted to the door 26 via the other one of the door frame elements 28. A set of hinge pins 49 rotationally couples the first and second sets of knuckles 46*a*, 46*b* to define the hinge rotational axis 45.

A wiring conduit 58 is mounted to the second hinge plate 44*b* and provides an interior passage 59 through which a conductor may pass, such as the conductor(s) of a wiring harness. While the wiring conduit 58 is mounted to the second hinge plate 44*b*, it is also at least partially received within the door 26.

A wire cover 56 is carried by the door assembly 24 such that a portion of the wire cover 56 is rotatably mounted to the wiring conduit 58 and rotates along an axis that is aligned with the rotational axis 45. In such a mounting, the wire cover 56 is rotatable between first and second positions, with the second position being illustrated in FIG. 2. In the first position, the wire cover 56 is rotated more toward the second hinge plate 44*b* to expose a backside of the wire cover 56. In the second position, the wire cover 56 is rotated more toward the first hinge plate 44*a* to hide the backside of the wire cover 56.

Figure 3:
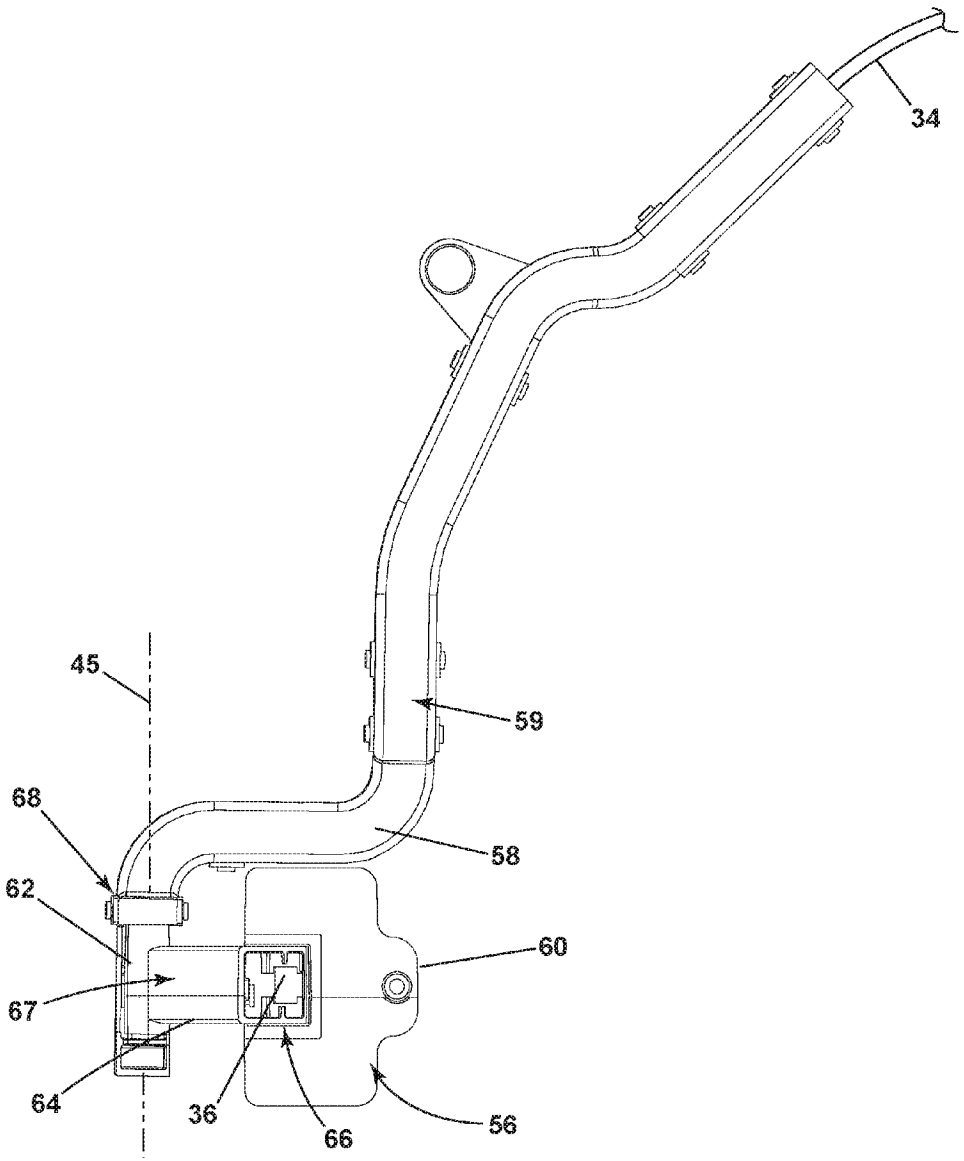
FIG. 3 is a rear view of the wire harness showing the wire cover in a first position.

As shown in FIG. 3, the wire cover 56 comprises a mounting plate 60 and conduit mount 62, which are connected by arm 64. A connector seat 66 is provided on the mounting plate 60. The conduit mount 62, arm 64 and connector seat 66 define an internal passage 67 through which a portion of the conductor 34, such as from a wiring harness in the door 26, is received and a connector 36 on the end of the conductor 34 can be fixed within the connector seat 66.

Figure 4A:
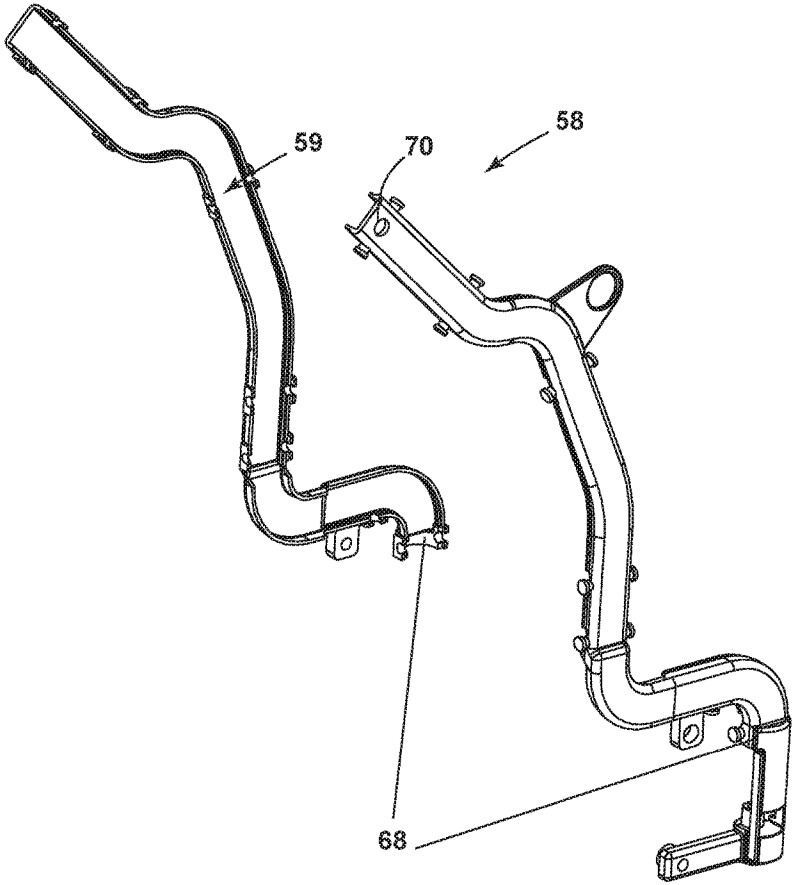
FIG. 4A is an exploded view of the wire conduit of FIG. 3.

The wire cover 56 and wiring conduit 58 are rotatably coupled together. While the rotational coupling can take any suitable form, as illustrated, the wiring conduit 58 encompasses the conduit mount 62 to form a rotary coupling 68. More specifically, a lower end of the wiring conduit 58 coaxially receives an end of the conduit mount 62 to form the rotary coupling 68. As illustrated in FIG. 4A, the wiring conduit 58 can be formed of two halves, which are snapped around the conduit mount 62 to form the rotary coupling 68. In this way, the passageway 59 of the wiring conduit 58 is coaxial with the passageway 67 of the conduit mount 62.

A strain relief 70 in the form of a small aperture is provided near the top of the wire conduit 58 to allow a zip-tie to run through the aperture and secure the conductor 34 in place. By securing the conductor 34 to the strain relief aperture 70, the lower portion of the conductor 34 can move freely between the strain relief 70 and the connector seat 66 without any tugging of the connector 36 when it is seated within the connector seat 66.

Figure 4B:
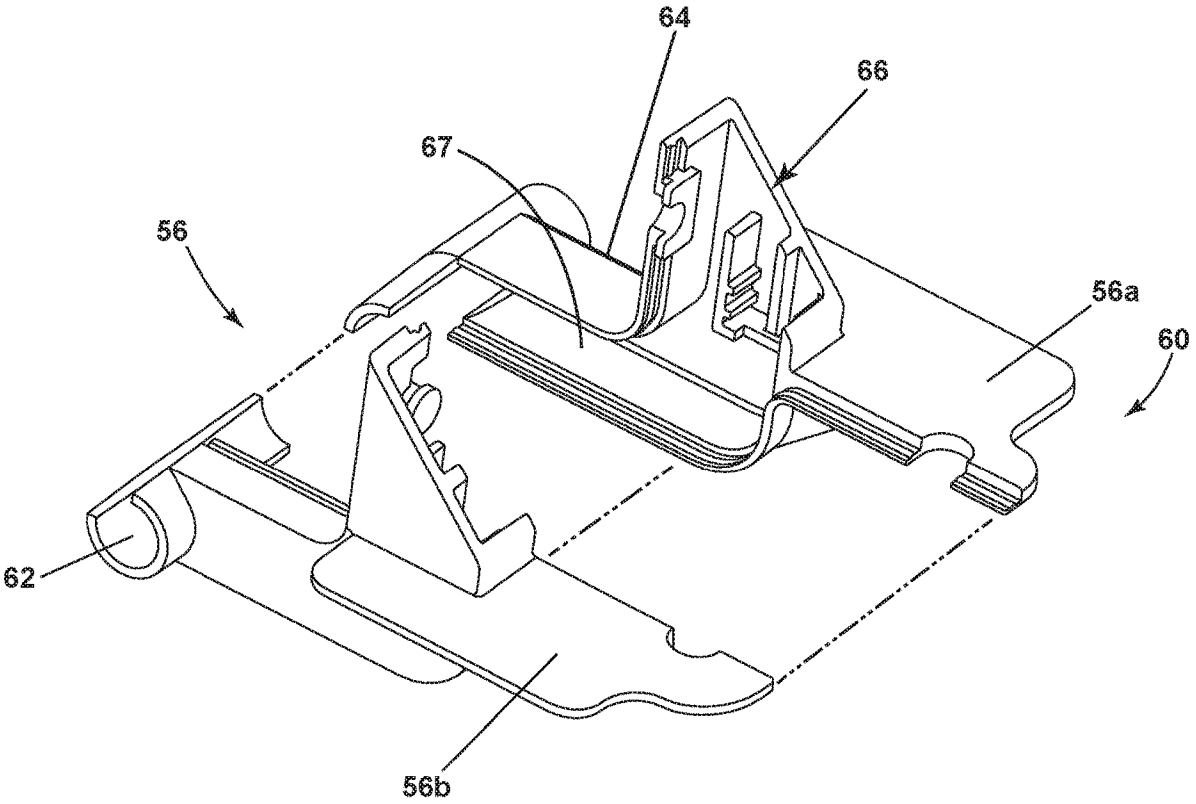
FIG. 4B is an exploded view of the wire cover of FIG. 3.

Referring to FIG. 4B, the wire cover 56 comprises first 56*a* and second 56*b* lateral halves, which utilizes a snap-fit mechanism to couple the first 56*a* and second 56*b* lateral halves to releasably secure them together. When secured together, the wire cover 56 forms the wire passageway 67 through the arm 64 to the interior of the conduit mount 62 and the connector seat 66. The conduit mount 62 is split into lateral halves along the length of the tube in such a way that a wire can be encased within the tube without running the end of the wire through the tube openings.

Figure 5:
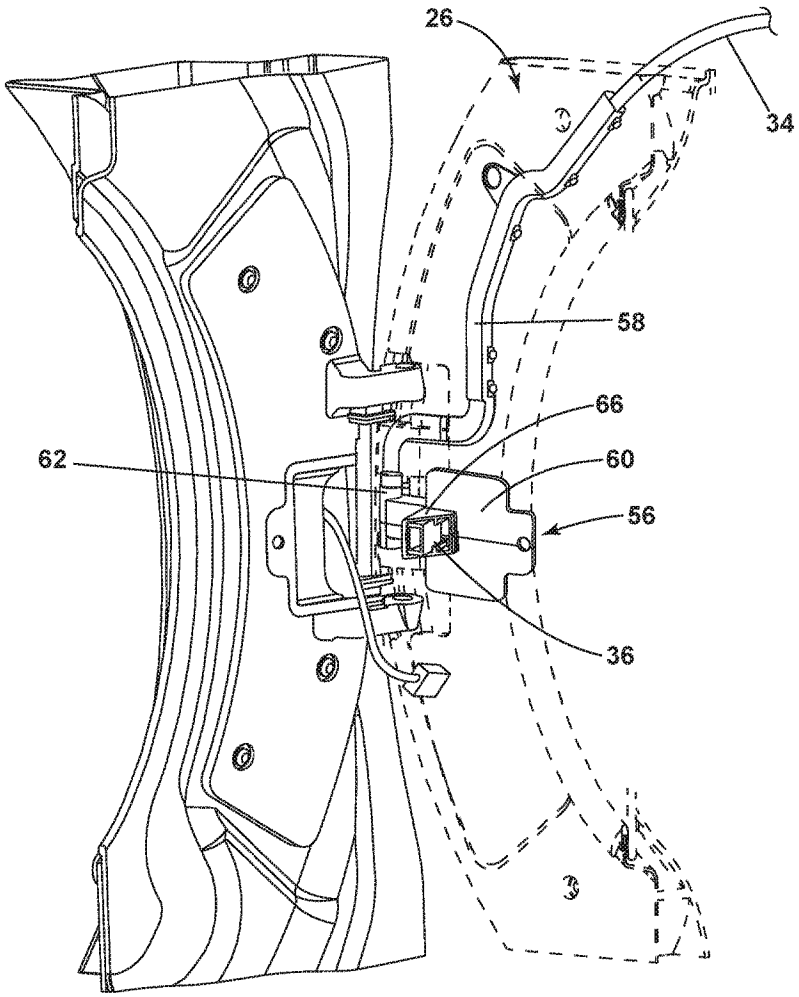
FIG. 5 is a perspective view illustrating the installation of the wire cover to the wire harness, with the wire cover in a first position and holding a first connector from the door, with a second connector from cabinet being free.

The method of assembling the wire cover 56 will be described with reference to FIGS. 5-7. The method of assembly is begun with the wire conduit 58 mounted to the door 26, the wire cover 56 rotatably mounted to the wire conduit 58, and the conductor 34 in the door 26 and the corresponding connector 36 already placed within the connector seat 66 as is shown in FIG. 4B. In this position, the mounting plate 60 is free to rotate relative to the wire conduit 58 and independently of the rotation of the door 26.

Figure 6:
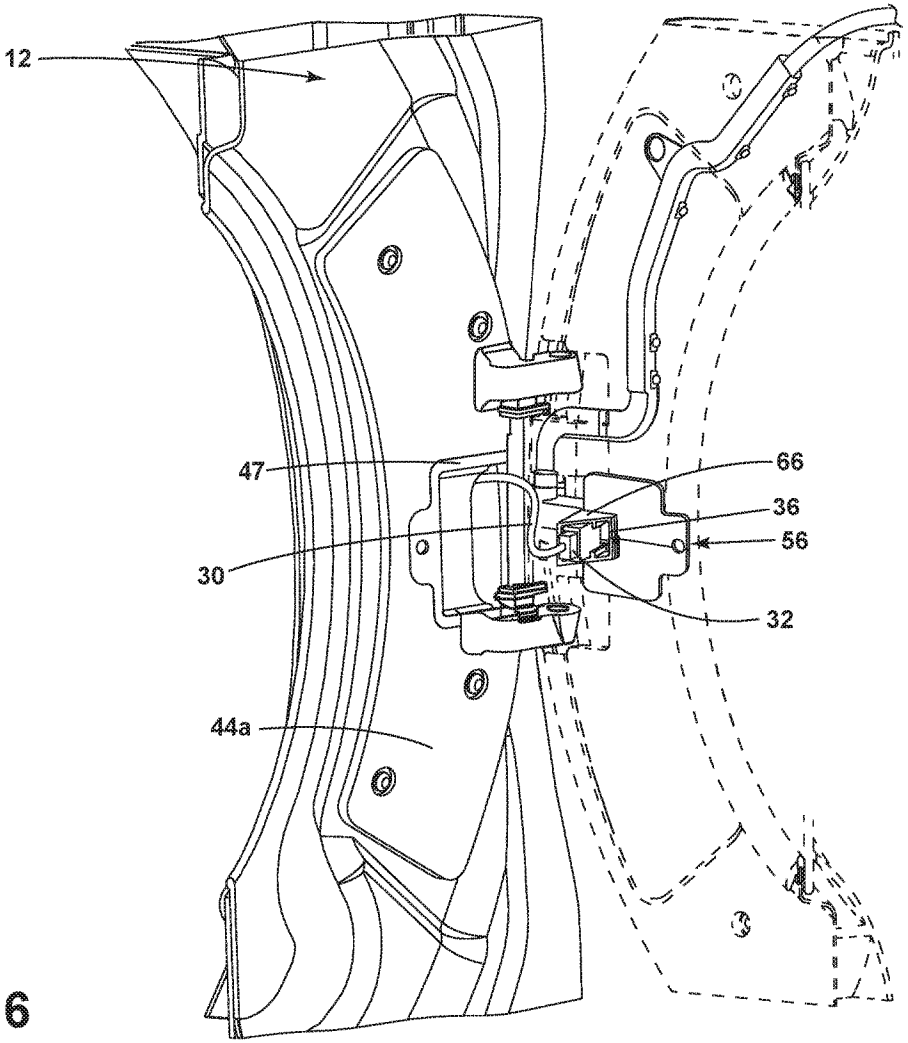
FIG. 6 is a perspective view illustrating the wire cover in the first position, with the first and second connectors coupled together.
Figure 7:
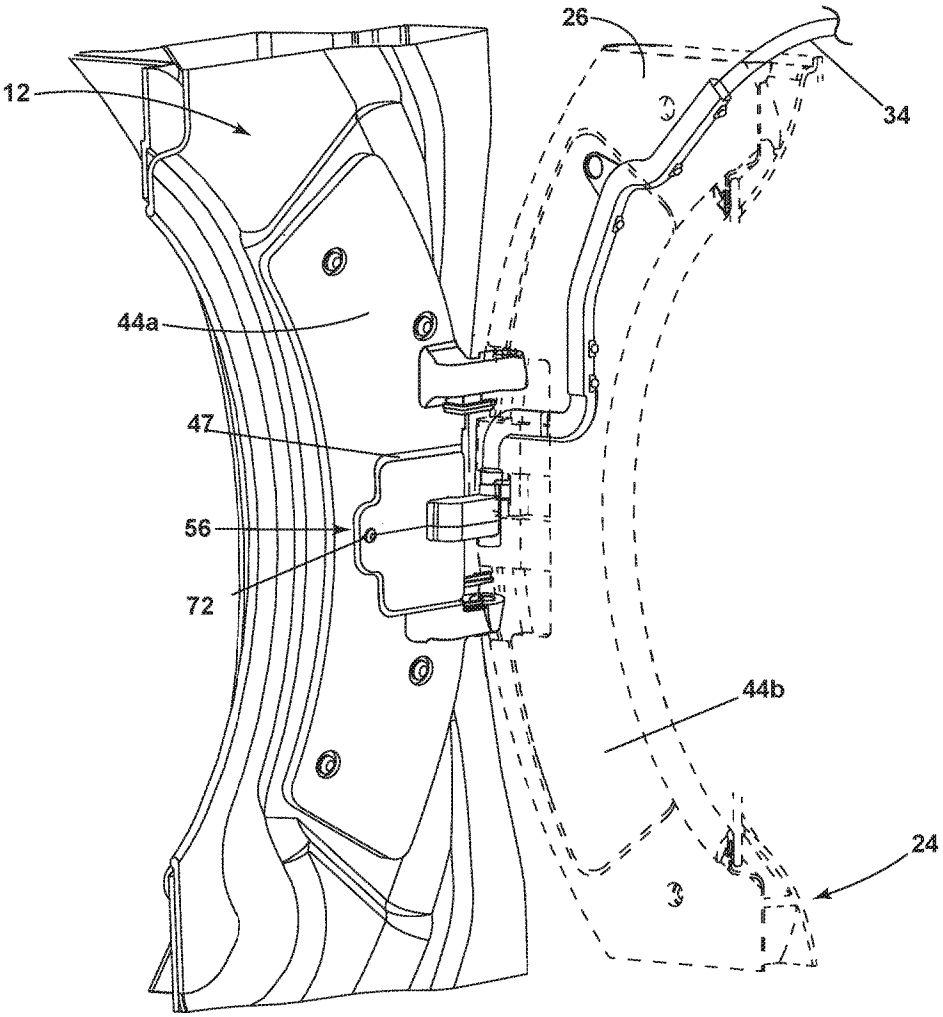
FIG. 7 is a perspective view illustrating the wire cover in a second position covering the conductors of the wire harness.

As shown in FIG. 6, the wire cover 56 is rotated to a first position away from the first hinge plate 44*a* to expose the slot 47 through which another connector 32 for the conductor 30 in the cabinet 12 can be pulled from or already extends from the cabinet 12. The connector 32 can then be connected to connector 36 residing in the connector seat 66. Referring to FIG. 7, after the connection is made, the wire cover 56 is rotated to a second position away from the second hinge plate 44*b* to hide the connected connectors 32, 36 between the cover 56 and the slot 47. The connectors can be received within the slot 47 as part of the movement of the wire cover 56 to the second position. In this position, the wire cover 56 overlies the slot 47. One or more fasteners 72 can be used to secure the cover 56 to the first hinge plate 44*a*.

The wire cover 56 provides for a convenient way to connect the connectors 32, 36 associated with the conductors 30, 34 in the cabinet 12, door 26, respectively, after the door 26 is mounted to the cabinet 12. This is a great benefit to the assembler of the appliance as the weight associated with all portions of the door assembly 24 or door 26 is carried by the cabinet 12 and the assembler need not hold any portion of the door assembly 24 or door 26 when making the connection. If the assembler needed to hold the door assembly 24 or door 26 while making the connection, then the assembly could require two individuals—one to hold the door and one to make the connection. Alternatively, if an assembler was working alone, the assembler would need to hold the door assembly 24 or door 26 while making the connection, which would be cumbersome. In the systems and methodologies disclosed herein, the assembler can mount the door 26 to the cabinet 12 prior to making the connection. Then, the assembler need only connect the connectors 32, 36, rotate the cover 56 adjacent the first hinge plate 44*a*, and secure the cover 56 to the first hinge plate 44*a* with fasteners.

The conductors in the cabinet 12 and door 26 are typically wiring harnesses located in each of the cabinet 12 and door 26, which are installed during the assembly of the cabinet 12 and door 26. The cover 56 simplifies the connecting of these wire harnesses.

The wire cover 56 protects the wire conductor 34 that passes through the hinge rotational axis 45 where it has a tendency to get pulled and damaged when the door 26 is in motion. The coaxial rotary coupling 68 also controls the rotation of the conductor to be at a desired location where the degree of twisting of the conductor associated with the opening/closing of the door 26 can be controlled. Further, the wire cover 56 with lateral halves 56*a*, 56*b* is designed for ease of installation during the assembly process where it can simply be snapped together to encase the wire conductors 34. Without the need to dismount or disassemble the door 26 to install the wire cover 56, assembly or maintenance process can be done by a single technician.

Although the embodiment of the present invention have been shown and described, it would be appreciated by those skilled in the art that changes may be made in these embodiments without departing from the principles and spirit of the invention, the scope of which is defined in the claims and their equivalents.

The invention claimed is:

1. An appliance door assembly comprising:

a first door frame having a first electrical conductor terminating in a first connector;

a second door frame having a second electrical conductor terminating in a second connector;

a hinge having a first hinge plate mounted to the first door frame, and a second hinge plate mounted to the second door frame, wherein the first hinge plate is rotatable relative to the second hinge plate about a hinge rotational axis; and a wire cover that is rotatable about the hinge rotational axis and holding the second connector; wherein:

when the door assembly is mounted to a laundry treating appliance, the wire cover is rotatable to:

a first position to expose the second connector for connection with the first connector when the first and second connectors are in a disconnected state; and a second position to hide the first and second connectors when the first and second connectors are in a connected state.

2. The appliance door assembly of claim 1 wherein the first hinge plate has a first knuckle, the second hinge plate has a second knuckle, and a hinge pin passes through the first and second knuckles to rotationally couple the first hinge plate and second hinge plate.

3. The appliance door assembly of claim 1 wherein the wire cover is secured in the second position by a fastener securing the wire cover to one of the first door frame or the first hinge plate.

4. The appliance door assembly of claim 1 wherein the first position is away from one of the first and second hinge plates.

5. The appliance door assembly of claim 4 wherein the wire cover comprises first and second lateral halves that are releasably secured together.

6. The appliance door assembly of claim 5 further comprising a snap fit coupling the first and second lateral halves to releasably secure them together.

7. The appliance door assembly of claim 1 further comprising a wiring conduit located within the second door frame and housing at least a part of the second conductor.

8. The appliance door assembly of claim 7 further comprising a rotary coupling rotatably connecting the wiring conduit to the wire cover.

9. The appliance door assembly of claim 8 wherein the wiring conduit receives a portion of the wire cover to form the rotary coupling.

10. The appliance door assembly of claim 1 wherein the first connector extends through an opening in one of the first door frame or first hinge plate.

11. The appliance door assembly of claim 10 wherein the wire cover overlies the opening in the second position.

12. The appliance door assembly of claim 1 wherein the first and second electrical conductors conduct at least one of electrical power or data.

13. The appliance door assembly of claim 1 wherein at least one of the first and second door frames defines an access opening.

14. The appliance door assembly of claim 13 wherein the other of the first and second door frames defines a window.

15. The appliance door assembly of claim 1 further comprising a user interface provided with one of the first and second door frames and connected to another end of the corresponding first and second electrical conductor.

16. A method of assembling an appliance door assembly to a cabinet, the door assembly having at least one of first and second door frames hingedly mounted for rotation about a rotational axis, the method comprising:

mounting the door assembly to the cabinet;

after mounting the door assembly, mounting a wire cover to the door assembly for rotation about the rotational axis;

securing a first electrical connector to the wire cover;

securing a second electrical connector to the first electrical connector;

rotating the wire cover to a predetermined position relative to the rotational axis to hide the connected first and second connectors; and securing the wire cover in the predetermined position.

17. The method of claim 16 further comprising passing the second electrical connector through an opening in the second door frame.

18. The method of claim 16 wherein securing the first electrical connector to the wire cover comprises assembly of at least two portions of the wire cover about the first electrical connector.

19. The method of claim 18 wherein assembly of the at least two portions comprises snap-fitting together at least two portions.

20. The method of claim 16 wherein securing the wire cover in the predetermined position comprises fastening the wire cover to one of the first and second door frames.

* * * * *